United States Patent [19]

Wrulich et al.

[11] 4,247,150

[45] Jan. 27, 1981

[54] BIT ARRANGEMENT FOR A CUTTING TOOL

[75] Inventors: Herwig Wrulich; Otto Schetina; Alfred Zitz, all of Zeltweg, Austria

[73] Assignee: Voest-Alpine Aktiengesellschaft, Vienna, Austria

[21] Appl. No.: 30,754

[22] Filed: Apr. 17, 1979

[30] Foreign Application Priority Data

Jun. 15, 1978 [AT] Austria ..... 4378/78

[51] Int. Cl.[3] ..... E21C 35/18

[52] U.S. Cl. ..... 299/86; 175/227; 175/354; 299/92

[58] Field of Search ..... 299/86, 92; 175/354, 175/371, 372

[56] References Cited

U.S. PATENT DOCUMENTS

| | | | |
|---|---|---|---|
| 1,792,604 | 2/1931 | Reed | 175/372 X |
| 3,820,848 | 6/1974 | Kniff | 175/354 X |
| 3,833,265 | 9/1974 | Elders | 299/86 |
| 3,841,707 | 10/1974 | Kniff et al. | 299/86 X |

*Primary Examiner*—Ernest R. Purser

*Attorney, Agent, or Firm*—Cushman, Darby & Cushman

[57] ABSTRACT

The rotary-shaft bit (7) inserted in a bushing (3) fixedly mounted, encloses by means of a hollow-cylindrical extension (9) an annular extension (5) of the bushing (3) and projecting in axial direction of said bushing (3), and in this manner is supported closer to the tip of the bit (8) in order to absorb transverse forces, noting that the front surface (14) of the hollow-cylindrical extension (9) of the bit (7) can be supported on the flange (4) of the bushing (3) (FIG. 1).

8 Claims, 3 Drawing Figures

BIT ARRANGEMENT FOR A CUTTING TOOL

The invention refers to a bit arrangement for a rotary mining tool, in which arrangement the shaft of the bit is rotatably mounted in a bushing fixedly inserted, particularly by pressing, in a bore of a bit holder, and which bushing comprises at its side facing the tip of the bit a flange abutting the bit holder. Such arrangements have become known per se, and in them the rotatable mounting of the bit has the advantage that the tip of the bit is used equally on all sides so that the service life of the bit is lengthened. Bits operate under very high stress, so that the guide in which the bit is rotatably mounted is subjected to considerable wear. By having the bit mounted in an inserted bushing it is possible to form the bushing of a material of greater resistance than the bit holder, so that again the service life is increased. Nevertheless, wear between bushing and bit in the known embodiments still is considerably high. When the performance is great and the work is done in hard rock the service life of the bits in such known embodiments often is only 1 to 1½ hours. When the guide has become crashed the bit will get clamped in the guide and the rotary motion of the bit is restricted or altogether prevented, and preventing the rotary motion of the bit leads to an exceedingly fast wearing down of the tip of the bit.

The invention now aims at eliminating these disadvantages and increasing the service life of the bits. The invention is essentially characterized by a bushing comprising an annular extension of smaller diameter than the flange and which projects over the flange as seen in axial direction, and by a bit and bit shaft, respectively, comprising a hollow-cylindrical extension, the inner diameter of which corresponds to the outer diameter of said annular extension, and which is designed to enclose said annular extension. Since the tip of the bit projects over the bushing the greatest wear between bushing and bit shaft is to be expected at that end of the bushing facing the tip of the bit, because forces running transversely to the axis of the bit are brought to act on the tip of the bit. Therefore, at this end of the bushing the transverse stress on the bearing is considerably stronger than on that end of the bit bushing facing away from the tip of the bit. By having the bushing extended beyond the flange and through the annular extension in the direction of the tip of the bit which in turn is enclosed by the hollow-cylindrical extension of the bit, the support is placed nearer to the tip of the bit. Besides, between this annular extension and the hollow-cylindrical extension a second bearing surface is created, so that in this area the number of bearing surfaces is doubled, so that the surface pressure brought to bear on one bearing surface is reduced. According to a preferred embodiment of the invention, the fit quality between the hollow-cylindrical extension and the outer diameter of the annular extension is equal to the fit quality between the bit shaft and the bushing, so that the bearing surfaces between the hollow-cylindrical extension and the annular extension in the corresponding axial areas of the bit are subjected to the same stress as the bearing surfaces between bit shaft and bushing. According to the invention, furthermore, the axial length of the hollow-cylindrical extension is dimensioned so great that the front surface of the hollow-cylindrical extension is supported by the flange of the bushing. By abutting the front surface of the hollow-cylindrical extension on the flange of the bushing a sealing surface is obtained. Thereby, already there, dust is largely prevented from entering on the bearing surfaces between the hollow-cylindrical extension and the annular extension. By the bearing gap between the hollow-cylindrical extension and the annular extension of the bushing, and the gap between the front surface of the annular extension and the base of the annular groove formed between the hollow-cylindrical extension and the bit shaft, an additional sealing of the inner space of the bushing against entering dust is created in the way of a labyrinth packing. In this manner, the bearing surfaces are widely kept free from dust so that their service life can be considerably increased. It has been demonstrated that the service life of the bits can be lengthened up to 3 to 4 times over known embodiments.

According to a further preferred embodiment of the invention in which the end of the bit shaft facing away from the tip of the bit in a manner known per se comprises an annular groove, into which a locking washer can be inserted, this locking washer is formed as a spring clip resiliently deflecting in axial direction of the bit. By means of this spring clip a fluttering of the bit is prevented and thus also the front surface of the hollow-cylindrical extension is prevented from temporarily leaving the flange of the bushing, so that permanent contact and sealing in this place is guaranteed.

According to the invention, the construction appropriately is such that the bit shaft on both ends of the bushing is mounted with a clearance necessary for a rotatable guiding and that between these two bearing surfaces there is an annular gap between bit and bushing, which can be filled with a lubricant. This will secure a constantly available extra supply of lubricant, and considering that bit and bit holder become considerably heated up during work the supply of lubricant to both bearing surfaces is guaranteed. In such an embodiment, according to the invention, a radial bore opening between bit holder and bushing may be provided in the bit holder, and which bore comprises a connection for a hydraulic pressure line. Due to the fact that the bore comprises a connection for a hydraulic pressure line the replacing of the pressed-in bushing in case of wearing out will be greatly facilitated. By the pressure of the hydraulic medium the bushing is compressed and can be quite easily ejected from the bore of the bit holder. If the hydraulic medium is oil, this oil will creep into the gap between the compressed bushing and the bore of the bit holder and the resulting lubrication will further facilitate ejection of the bushing.

In order to safeguard a tight fitting of the bushing in the bore of the bit holder, according to the invention, also the outer surface of the bushing and possibly also the walls of the bore in the bit holder can be formed conically, for instance having a taper of about 6°.

In the drawing the invention is schematically illustrated by way of an example of embodiment.

Figure 1:
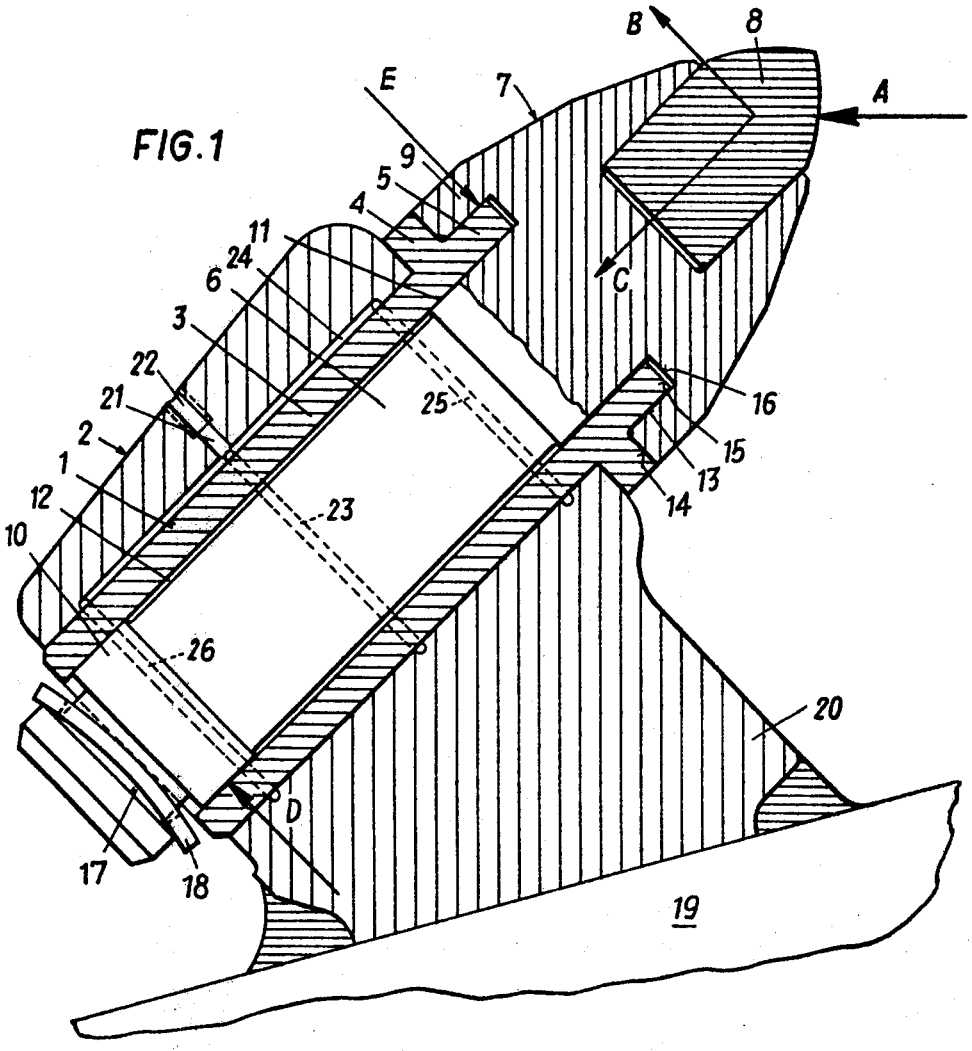
FIG. 1 shows a sectional view of the bit holder and the bit.

Into a bore 1 of the bit holder 2 a bushing 3 is pressed. The bushing 3 has a flange 4 beyond which projects an annular extension 5. The shaft 6 of the bit 7, into which a hard-metal point 8 is inserted, has a hollow-cylindrical extension 9 which forms an axially facing annular groove enclosing the annular extension 5. The bit shaft itself has a greater diameter at its back end 10 and at its front end 11, which ends 10 and 11 said bit shaft is inserted in the bushing in a running fit. Between the two ends 10 and 11 the diameter of the bit shaft is reduced, so that there is an annular gap 12 between bushing 3 and bit shaft 6 which is filled with a lubricant. Thus, the shaft 6 is supported against the inner surface of the bushing 3 at its two ends 10 and 11, only.

Another bearing support 13 is achieved between the hollow-cylindrical extension 9 and the annular extension 5, so that on the end facing the tip of the bit 8 or the bit holder, respectively, is twice supported, i.e. on the bearing ends 11 and 13. The front surface 14 of the annular extension 9 is supported against the flange. Between the front surface 15 of the annular extension 5 and the basic surface 16 of the groove formed between the hollow-cylindrical extension 9 and the bit shaft portion 11 there exists a slight gap, so that the front surface 14 of the hollow-cylindrical extension is secured to abut the flange 4.

Figure 2:
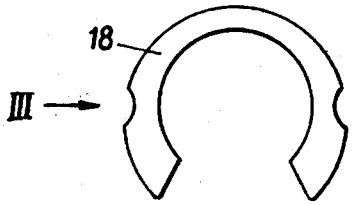
FIGS. 2 and 3 show the spring clip 2, FIG. 2 being a view in direction of arrow II of FIG. 3 and FIG. 3 being a view in direction of arrow III of FIG. 2.
Figure 3:
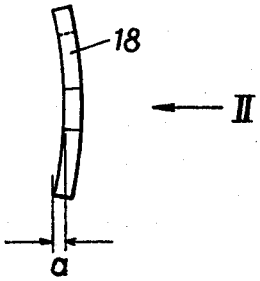

At its end facing away from the bit shaft the bit shaft has an annular groove 17 into which is inserted a spring clip 18. This spring clip 18, as shown in FIGS. 2 and 3, has a curvature of a pitch a, ensuring constant contact of the front surface 14 of the annular extension 9 with the flange 4 and preventing a fluttering of the bit.

19 is the rotary mining tool, for instance a rotary mining head, onto which is welded the foot 20 of the bit holder 2.

During cutting certain forces are generated in direction of the arrow A. B and C are the resultant forces acting on the bit holder. These forces are absorbed by two forces D and E. It is shown that the force E is considerably greater than the force D and this force E now is absorbed by the two bearing supports 11 and 13. By the fact that these bearing surfaces 11 and 13 are placed near the tip of the bit the force D is kept in lower ranges.

21 is a bore in the bit holder 2, which opens into a groove 23 between bit holder 2 and bushing 3. This bore is provided with a thread 22 for being connected with a hydraulic pressure line. Via an axial groove 24 in the bit holder the bore 21 is connected with two more annular grooves 25 and 26. By applying pressure oil is pressed in this manner into the fitting gap to reduce greatly the friction between the fitting surfaces so that the bushing 3 can easily be drawn out of the holder 2.

What is claimed is:

1. A bit assembly for a rotary mining tool comprising: a bit holder having a bore therein; a non-rotating bushing fixed in the bore of the bit holder, said bushing having a radial flange thereon, said flange having a first surface facing and abutting said bit holder and a second surface facing away from said bit holder, said bushing also having an annular extension of smaller diameter than said flange projecting axially beyond the flange in a direction away from said bit holder; a bit having a shaft portion rotatably mounted in said bushing and having a bit portion of enlarged diameter, said annular extension on said bushing fitting into a complementary axially facing annular groove in said bit portion so that said bit portion encloses said annular extension, and said bit portion having a surface supported on said second surface of said flange on said bushing.

2. A bit assembly as in claim 1 wherein the fit between the outer diameter of the annular extension on said bushing and said groove in said bit portion is equal to the fit between said bit shaft portion and said bushing.

3. A bit assembly as in claim 1 or 2 wherein the clearance between said bit shaft portion and said bushing is less at the ends of said shaft portion than the clearance between the remainder of said shaft portion and said bushing whereby the latter clearance forms an annular gap which can be filled with lubricant.

4. A bit assembly as in claim 3 wherein said bit holder has a radial bore connecting at its inner end with said annular gap, the outer end of said radial bore having a connection for a hydraulic pressure line.

5. A bit assembly as in claim 1 or 2 wherein the end of said bit shaft portion opposite said bit portion projects out of said bit holder and has an annular groove therein fitted with a spring clip which resiliently deflects in axial direction relative to said bit.

6. A bit assembly as in claim 1 wherein said bushing is conical.

7. A bit assembly as in claim 6 wherein said bore in said bit holder is conical.

8. A bit assembly as in claim 6 or 7 wherein the angle of taper is about 6°.

* * * * *